US005996118A

United States Patent [19]

Carlone

[11] Patent Number: 5,996,118

[45] Date of Patent: Dec. 7, 1999

[54] DISHWASHING AID

[76] Inventor: Vincent L. Carlone, 434 Birchwood Dr., Duanesburg, N.Y. 12056

[21] Appl. No.: 09/174,350

[22] Filed: Oct. 15, 1998

[51] Int. Cl.[6] ..... A41B 13/10; A41D 13/00

[52] U.S. Cl. ..... 2/48; 2/463; 2/51

[58] Field of Search ..... 2/463, 464, 48, 2/50, 51, 52

[56] References Cited

U.S. PATENT DOCUMENTS

| | | |
|---|---|---|
| 1,598,041 | 8/1926 | Bloom et al. . |
| 2,473,740 | 6/1949 | Welch . |
| 2,637,852 | 5/1953 | Globe . |
| 3,611,438 | 10/1971 | Gregg et al. . |
| 4,030,139 | 6/1977 | Sonntag . |
| 4,134,152 | 1/1979 | Pierre . |
| 4,682,372 | 7/1987 | Peterson et al. . |
| 5,075,897 | 12/1991 | Daniels . |
| 5,465,423 | 11/1995 | Taylor-Varney . |
| 5,465,424 | 11/1995 | Cudney et al. . |
| 5,692,246 | 12/1997 | Benedick . |
| 5,738,257 | 4/1998 | McConnell . |

*Primary Examiner*—John J. Calvert
*Assistant Examiner*—Shirra L Jenkins

[57] ABSTRACT

A new dishwashing aid for providing a person a more comfortable and easier way of washing dishes. The inventive device includes a chest plate dimensioned for covering a chest of a user. The chest plate is supported on a counter area of a sink. A hip plate is provided that is dimensioned for covering a pelvic region of the user. The hip plate is adjustably coupled with respect to the chest plate.

7 Claims, 2 Drawing Sheets

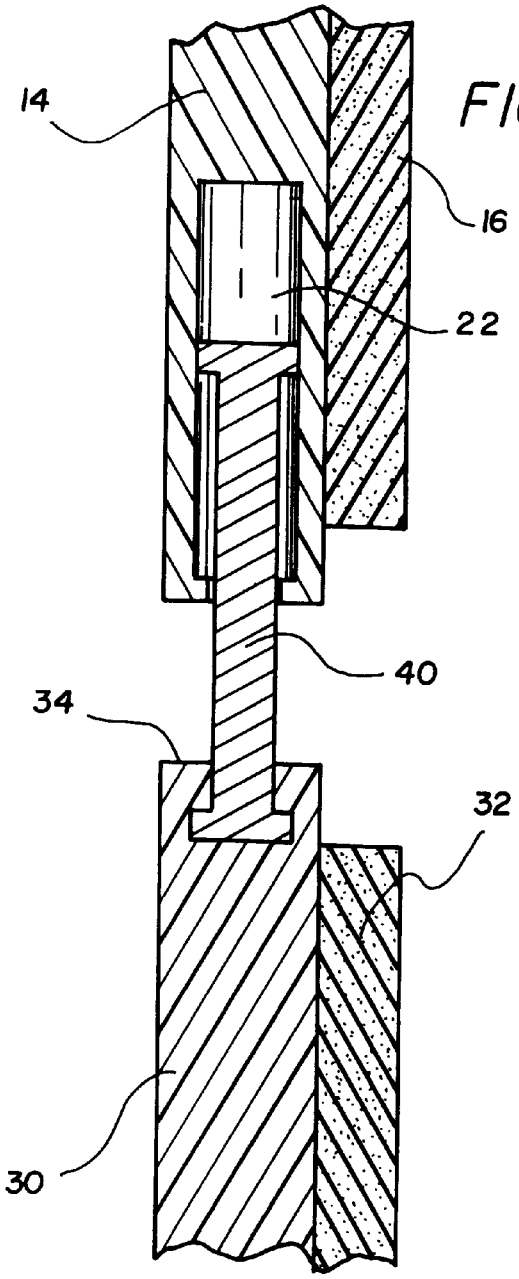
FIG.3
FIG.4
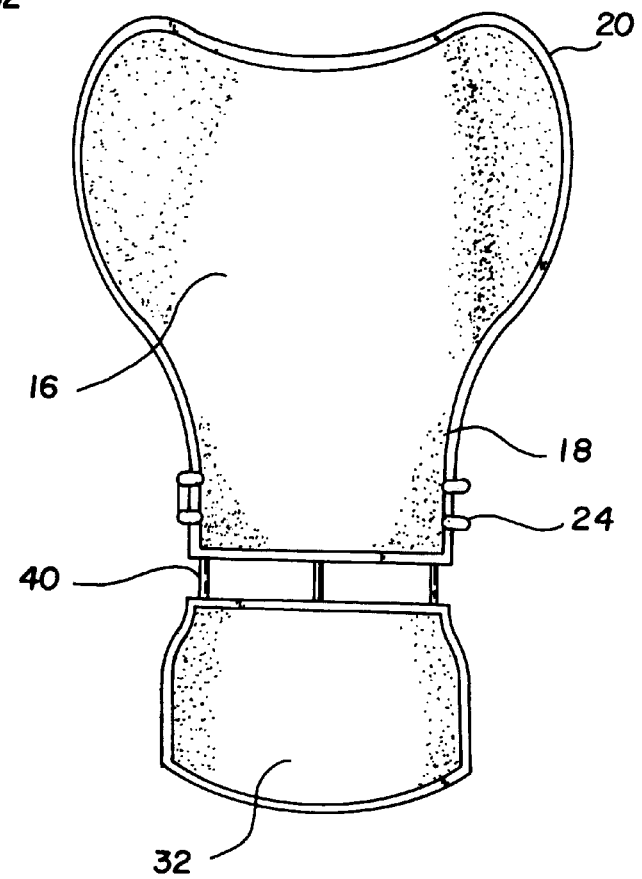

DISHWASHING AID

BACKGROUND OF THE INVENTION

1. Field of the Invention

The present invention relates to cleaning shields and more particularly pertains to a new dishwashing aid for providing a person a more comfortable and easier way of washing dishes.

2. Description of the Prior Art

The use of cleaning shields is known in the prior art. More specifically, cleaning shields heretofore devised and utilized are known to consist basically of familiar, expected and obvious structural configurations, notwithstanding the myriad of designs encompassed by the crowded prior art which have been developed for the fulfillment of countless objectives and requirements.

Known prior art cleaning shields include U.S. Pat. No. 5,012,537 to Underwood; U.S. Pat. No. 4,878,257 to Hardin; U.S. Pat. No. 5,330,262 to Peters; U.S. Pat. No. 4,722,103 to Kliebert; U.S. Pat. No. Des. 266,052 to Moser; and U.S. Pat. No. 4,183,097 to Mellian.

While these devices fulfill their respective, particular objectives and requirements, the aforementioned patents do not disclose a new dishwashing aid. The inventive device includes a chest plate dimensioned for covering a chest of a user. The chest plate is supported on a counter area of a sink. A hip plate is provided that is dimensioned for covering a pelvic region of the user. The hip plate is adjustably coupled with respect to the chest plate.

In these respects, the dishwashing aid according to the present invention substantially departs from the conventional concepts and designs of the prior art, and in so doing provides an apparatus primarily developed for the purpose of providing a person a more comfortable and easier way of washing dishes.

SUMMARY OF THE INVENTION

In view of the foregoing disadvantages inherent in the known types of cleaning shields now present in the prior art, the present invention provides a new dishwashing aid construction wherein the same can be utilized for providing a person a more comfortable and easier way of washing dishes.

The general purpose of the present invention, which will be described subsequently in greater detail, is to provide a new dishwashing aid apparatus and method which has many of the advantages of the cleaning shields mentioned heretofore and many novel features that result in a new dishwashing aid which is not anticipated, rendered obvious, suggested, or even implied by any of the prior art cleaning shields, either alone or in any combination thereof.

To attain this, the present invention generally comprises a chest plate dimensioned for covering a chest of a user. The chest plate includes a rigid outer surface and a padded interior surface. The chest plate further includes a narrow lower portion and an outwardly curving upper portion. The narrow lower portion has a plurality of channels extending upwardly thereof within the rigid outer surface. The rigid outer surface of the narrow lower portion has a pair of engagement hangers extending outwardly of opposing sides thereof. The engagement hangers support the chest plate on a counter area of a sink. A hip plate is provided that is dimensioned for covering a pelvic region of the user. The hip plate includes a rigid outer surface and a padded interior surface. The hip plate further includes a planar upper edge, an arcuate lower edge and planar side edges. The planar upper edge has a plurality of rods extending upwardly therefrom. The plurality of rods are slidably received within the plurality of channels in the chest plate for adjustable coupling of the hip plate with the chest plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new dishwashing aid apparatus and method which has many of the advantages of the cleaning shields mentioned heretofore and many novel features that result in a new dishwashing aid which is not anticipated, rendered obvious, suggested, or even implied by any of the prior art cleaning shields, either alone or in any combination thereof.

It is another object of the present invention to provide a new dishwashing aid which may be easily and efficiently manufactured and marketed.

It is a further object of the present invention to provide a new dishwashing aid which is of a durable and reliable construction.

An even further object of the present invention is to provide a new dishwashing aid which is susceptible of a low cost of manufacture with regard to both materials and labor, and which accordingly is then susceptible of low prices of sale to the consuming public, thereby making such dishwashing aid economically available to the buying public.

Still yet another object of the present invention is to provide a new dishwashing aid which provides in the apparatuses and methods of the prior art some of the advantages thereof, while simultaneously overcoming some of the disadvantages normally associated therewith.

Still another object of the present invention is to provide a new dishwashing aid for providing a person a more comfortable and easier way of washing dishes.

Yet another object of the present invention is to provide a new dishwashing aid which includes a chest plate dimensioned for covering a chest of a user. The chest plate is supported on a counter area of a sink. A hip plate is provided that is dimensioned for covering a pelvic region of the user. The hip plate is adjustably coupled with respect to the chest plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view of the present invention as taken along line 3—3 of FIG. 2.

FIG. 4 is a rear elevation view of the present invention.

DESCRIPTION OF THE PREFERRED EMBODIMENT

Figure 1:
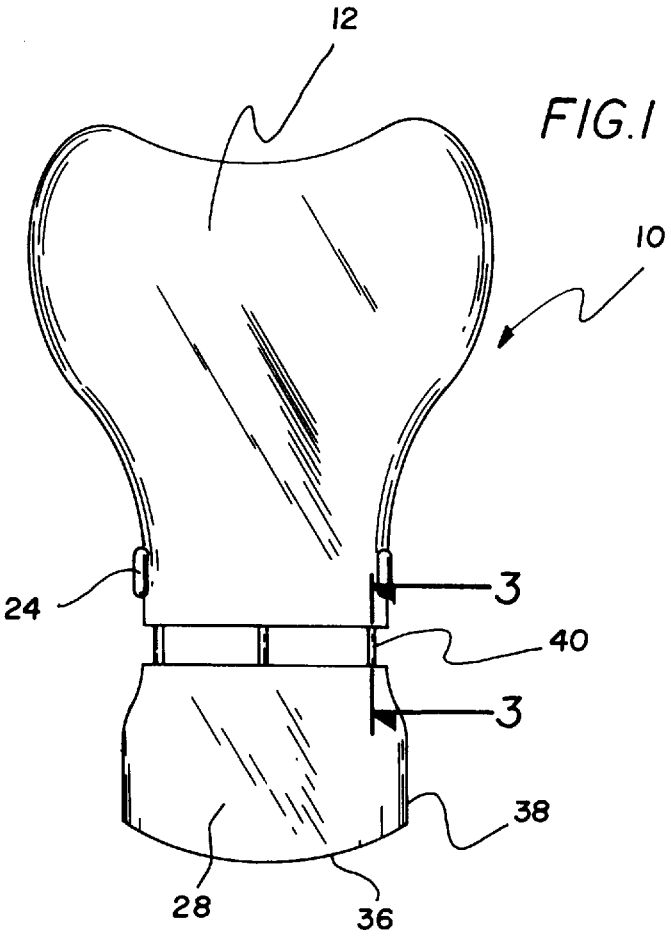
FIG. 1 is a front view of a new dishwashing aid according to the present invention.
Figure 2:
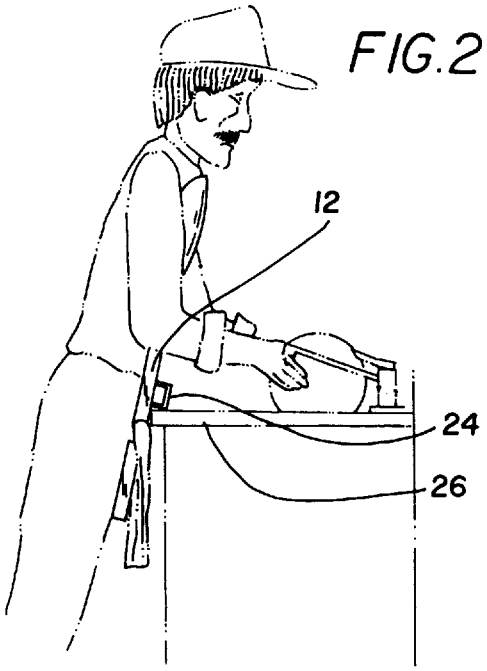
FIG. 2 is a side view of the present invention illustrated in use.

With reference now to the drawings, and in particular to FIGS. 1 through 4 thereof, a new dishwashing aid embodying the principles and concepts of the present invention and generally designated by the reference numeral 10 will be described.

As best illustrated in FIGS. 1 through 4, the dishwashing aid 10 comprises a chest plate 12 dimensioned for covering a chest of a user. The chest plate 12 includes a rigid outer surface 14 and a padded interior surface 16. The chest plate 12 further includes a narrow lower portion 18 and an outwardly curving upper portion 20. The narrow lower portion 18 has a plurality of channels 22 extending upwardly thereof within the rigid outer surface 14. The rigid outer surface 14 of the narrow lower portion 18 has a pair of engagement hangers 24 extending outwardly of opposing sides thereof. The engagement hangers 24 support the chest plate 12 on a counter area 26 of a sink.

A hip plate 28 is provided that is dimensioned for covering a pelvic region of the user. The hip plate 28 includes a rigid outer surface 30 and a padded interior surface 32. The hip plate 28 further includes a planar upper edge 34, an arcuate lower edge 36 and planar side edges 38. The planar upper edge 34 has a plurality of rods 40 extending upwardly therefrom. The plurality of rods 40 are slidably received within the plurality of channels 22 in the chest plate 12 for adjustable coupling of the hip plate 28 with the chest plate 12. The hip plate 28 can be adjusted with respect to the chest plate 12 by sliding the rods 40 within the channels 22 until the separation between the hip plate 28 and the chest plate 12 is sufficient so as to comfortably support the user while washing dishes.

In use, the chest plate 12 and the hip plate 28 would be positioned so as to shield an individual from getting splashed with soapy dish water. The user simply places the engagement hangers 24 in place atop the counter 26 of the sink and leans against the chest plate 12 with the hip plate 28 pressing against the pelvic region. This would allow the user to wash dishes without bending over, which could result in a sore back.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new dishwashing aid for providing a person a more comfortable and easier way of washing dishes comprising, in combination:

a chest plate dimensioned for covering a chest of a user, the chest plate including a rigid outer surface and a padded interior surface, the chest plate further including a narrow lower portion and an outwardly curving upper portion, the narrow lower portion having a plurality of channels extending upwardly thereof within the rigid outer surface, the rigid outer surface of the narrow lower portion having a pair of engagement hangers extending outwardly of opposing sides thereof, the engagement hangers supporting the chest plate on a counter area of a sink; and a hip plate dimensioned for covering a pelvic region of the user, the hip plate including a rigid outer surface and a padded interior surface, the hip plate further including a planar upper edge, an arcuate lower edge and planar side edges, the planar upper edge having a plurality of rods extending upwardly therefrom, the plurality of rods slidably received within the plurality of channels in the chest plate for adjustable coupling of the hip plate with the chest plate.

2. A new dishwashing aid for providing a person a more comfortable and easier way of washing dishes comprising, in combination:

a chest plate dimensioned for covering a chest of a user, the chest plate having means supporting the chest plate on a counter area of a sink; and a hip plate dimensioned for covering a pelvic region of the user, the hip plate being adjustably coupled with respect to the chest plate.

3. The dishwashing aid as set forth in claim 2 wherein the chest plate includes a rigid outer surface and a padded interior surface.

4. The dishwashing aid as set forth in claim 3 wherein the chest plate further includes a narrow lower portion and an outwardly curving upper portion, the narrow lower portion having a plurality of channels extending upwardly thereof within the rigid outer surface.

5. The dishwashing aid as set forth in claim 4 wherein the hip plate further includes a planar upper edge, an arcuate lower edge and planar side edges, the planar upper edge having a plurality of rods extending upwardly therefrom, the plurality of rods slidably received within the plurality of channels in the chest plate for adjustable coupling of the hip plate with the chest plate.

6. The dishwashing aid as set forth in claim 3 wherein the rigid outer surface of the narrow lower portion have a pair of engagement hangers extending outwardly of opposing sides thereof, the engagement hangers supporting the chest plate on the counter area of a sink.

7. The dishwashing aid as set forth in claim 2 wherein the hip plate includes a rigid outer surface and a padded interior surface.

* * * * *